US005913628A

United States Patent [19]

Sides, II

[11] Patent Number: 5,913,628

[45] Date of Patent: Jun. 22, 1999

[54] PREFORMED PAPER CATCHING TRAY FOR ELECTRONIC PRINTERS AND OTHER DEVICES

[76] Inventor: William R. Sides, II, P.O. Box 432, Hana, Hi. 96713

[21] Appl. No.: 09/135,584

[22] Filed: Aug. 18, 1998

Related U.S. Application Data

[63] Continuation-in-part of application No. 09/106,710, Jun. 29, 1998.

[51] Int. Cl.[6] ..... B65H 29/26

[52] U.S. Cl. ..... 400/679; 400/625; 271/209

[58] Field of Search ..... 400/625, 679, 400/718, 717; 271/209

[56] References Cited

U.S. PATENT DOCUMENTS

| | | | |
|---|---|---|---|
| 3,154,356 | 10/1964 | Lewis et al. | 271/207 |
| 3,617,053 | 11/1971 | Menard | 271/64 |
| 3,704,793 | 12/1972 | Nichol et al. | 214/7 |
| 3,807,726 | 4/1974 | Hope et al. | 271/207 |
| 4,220,323 | 9/1980 | Smith | 271/207 |
| 4,836,526 | 6/1989 | Melnik | 271/209 |
| 4,995,602 | 2/1991 | Nakadai et al. | 271/207 |
| 5,040,777 | 8/1991 | Bell et al. | 271/3 |
| 5,172,905 | 12/1992 | Vanous et al. | 271/207 |
| 5,190,167 | 3/1993 | Andrews et al. | 211/50 |
| 5,207,417 | 5/1993 | Bell et al. | 271/175 |
| 5,388,818 | 2/1995 | Anton et al. | 271/209 |

FOREIGN PATENT DOCUMENTS

| | | | |
|---|---|---|---|
| 0130855 | 8/1983 | Japan | 271/207 |
| 0044461 | 3/1985 | Japan | 271/207 |
| 0286563 | 11/1990 | Japan | 271/207 |

OTHER PUBLICATIONS

Elliott et al., Passive Collation Tray, Xerox Disclosure Journal, vol. 12, No.3. pp. 135 and 136, May 6, 1987.

Sakai, Sheet Stacker, IBM Technical Disclosure Bulletin, vol.24 No.2, pp. 899,900, Jul. 1981.

*Primary Examiner*—Edgar Burr

*Assistant Examiner*—Anthony H. Nguyen

*Attorney, Agent, or Firm*—Caesar, Rivise, Bernstein, Cohen & Pokotilow, Ltd.

[57] ABSTRACT

A tray for use with printer, copier, facsimile machine or any other device from which sheets of paper are expelled and which is arranged to be located on a support surface, e.g., a table, desk, etc., having an edge. The tray may be formed so that it is collapsible and arranged to be stored in a collapsed state in a flat container. Whether collapsible or not the tray is arranged to be releasably mounted on the support surface adjacent and completely below the device to collect the sheets of paper expelled from the device. The tray has a basket section, an anchor section, and an intermediate support section. The anchor section is arranged to be located on the support surface under the device so that the weight of the device holds it in place. The intermediate support section is hingedly connected to the anchor section and overhangs the edge of the support surface when the tray is in place. The basket section is hingedly connected to the intermediate support section so that it is suspended from the intermediate support section and overhangs the edge of the support surface. The basket section has a wedge shaped interior bounded by a front wall extending at an angle to vertical when said basket section is suspended overhanging the edge of the support surface. The tray is adjustable with respect to the device when suspended so that the first sheet of paper expelled from the device drops directly into said hollow interior of the basket section and rests against its front wall and the next successive sheet drops into the hollow interior and rests against the first sheet. Successive sheets drop into the basket section in a similar manner to form a collated stack of sheets of paper. A backer panel may be provided to be releasably secured to the basket section to hold the basket section at a desired orientation of its front wall. The tray may be formed so as to be of a fixed shape and configuration, e.g., molded, of plastic.

18 Claims, 11 Drawing Sheets

FIG. 3A
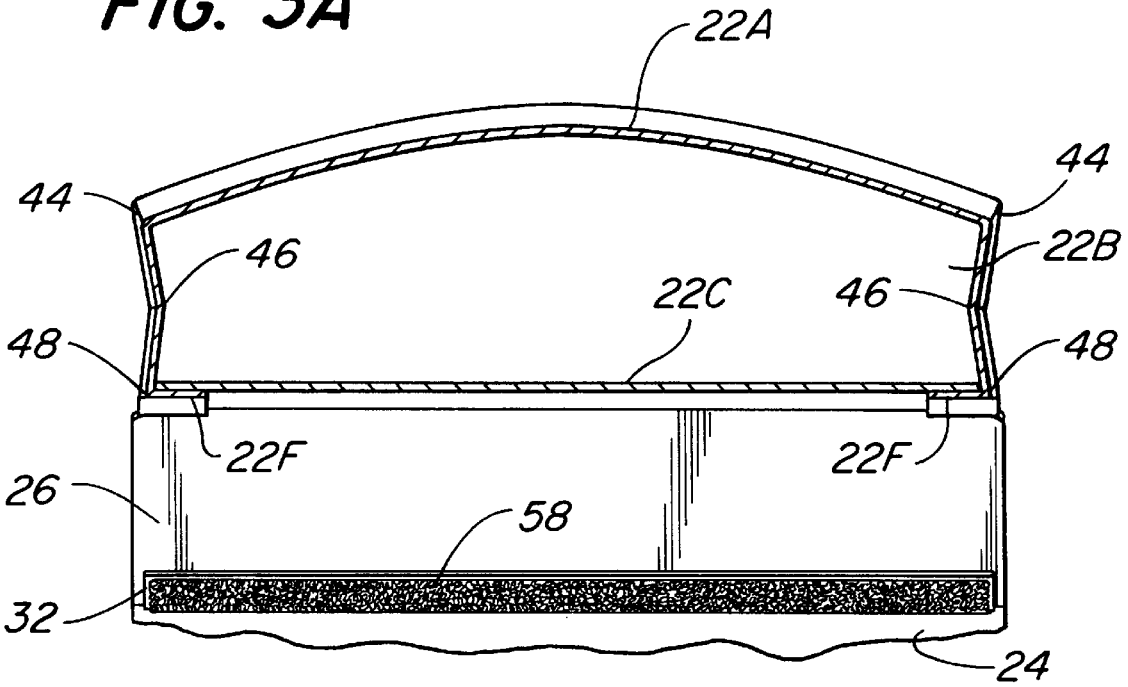
FIG. 3B
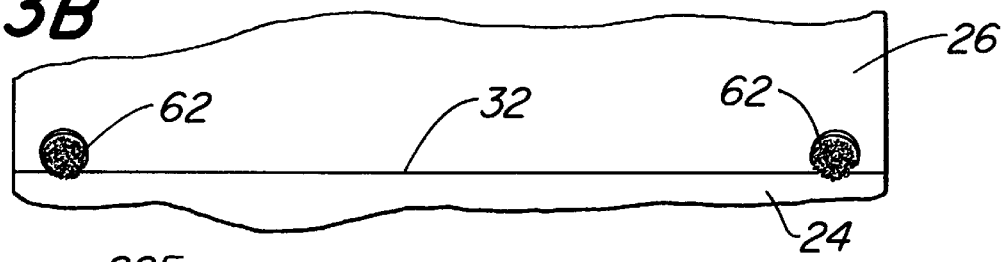
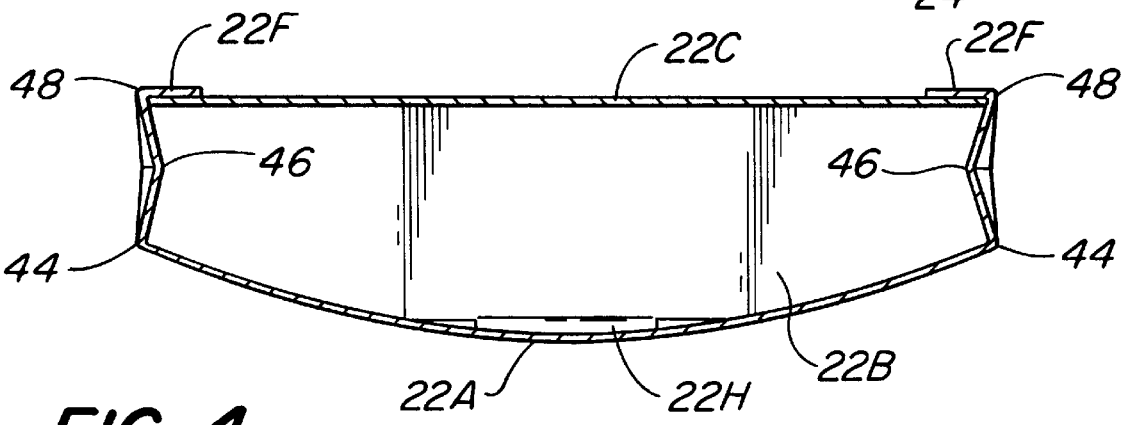
FIG. 4

10
10A
P
12A
32
24
12
56
58
52
54
22
60

FIG. 8
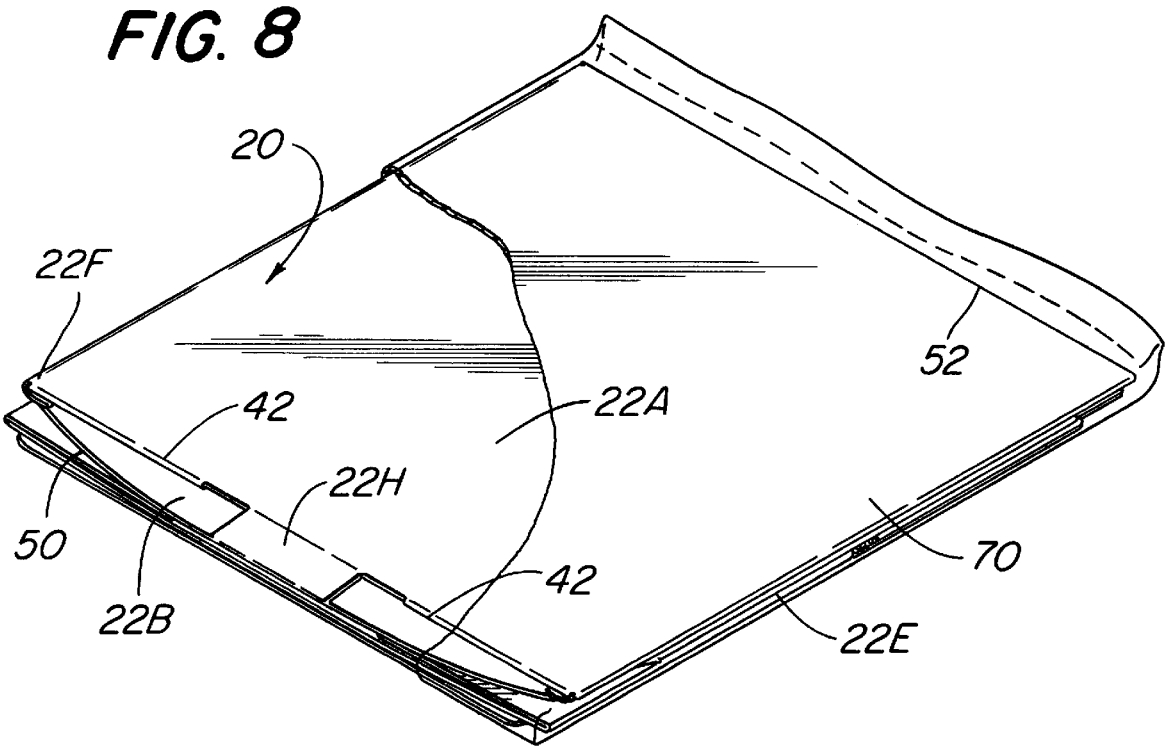
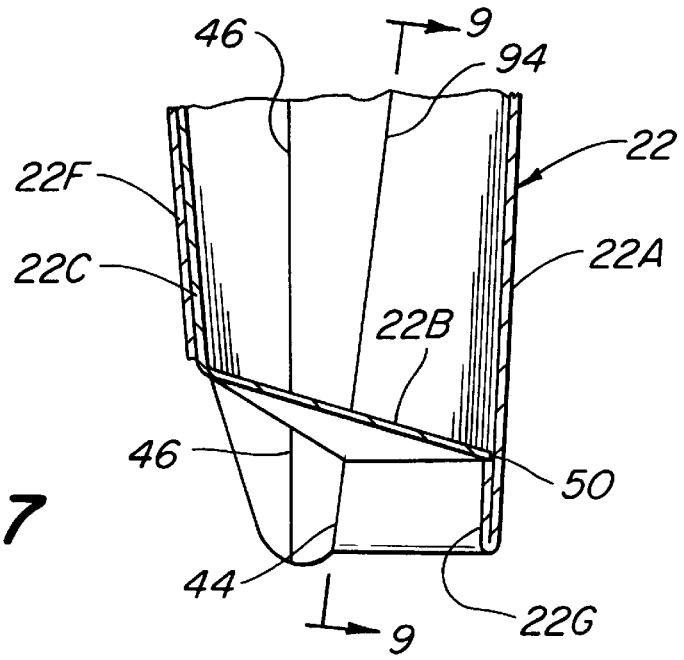
FIG. 7

PREFORMED PAPER CATCHING TRAY FOR ELECTRONIC PRINTERS AND OTHER DEVICES

This application is a Continuation-In-Part of my earlier application Ser. No. 09/106,710 filed on Jun. 29, 1998, entitled "Paper Catching Tray for Electronic Printers And Other Devices," whose disclosure is incorporated by reference herein.

BACKGROUND OF THE INVENTION

This invention relates to paper trays, in general, and, more particularly, to trays which are particularly adapted to be used with any type of electronic device which expels individual sheets of paper, such as printers, copiers, facsimile machines, scanners, etc.

With the advent of computers, facsimile machines, copiers, scanners, printers, etc., offices, homes and other institutions now commonly make use of such equipment to generate documents. In some cases the equipment includes means to automatically collect and/or collate the documents (e.g., papers) expelled therefrom. In many cases, particularly printers, copiers, scanners, facsimile machines and the like designed for small office and/or home use no paper collectors are provided as part of the machine. Thus, users of such machines may be required to purchase additional components to collect and/or collate the exiting paper.

There are several prior art patents disclosing paper collection devices, such as trays, for use with photocopy and other machines. For example, U.S. Pat. No. 3,617,053 (Menard) discloses a copy receiving tray for use with a copier which is mounted on a table so that a portion of the tray is located directly at the point in the copier from which the papers exit. The tray of this patent includes various guide surfaces which are located at the point at which the papers exit the copier to help guide them into the paper receiving cavity disposed therebelow. To further the guidance of the exiting paper into the paper receiving cavity the Menard device also makes use of a spring biased member which extends above and below the point at which the papers exit to act as a stop and guide to direct the exiting sheets of paper downward into the paper receiving cavity. As should be appreciated by those skilled in the art the combination of guide surfaces and the spring biased front section located opposite the point at which the papers exit the machine results in a rather complex, cumbersome and inherently expensive configuration. Moreover, the Menard patent's tray is not collapsible and thus is not suitable for compact storage when not in use.

Other prior art patents disclosing devices for use with copiers or other electronic devices from which sheets of paper are expelled to collect and/or collate the sheets are U.S. Pat. Nos.: 3,154,356 (Lewis et al.), 3,704,793 (Nicol et al.), 3,807,726 (Hope et al.), 4,836,526 (Melnik), 4,995,602 (Nakadai et al.), 5,040,777 (Bell et al.), 5,190,167 (Andrews et al.), 5,207,417 (Bell et al.) and 5,388,818 (Anton et al.) While the foregoing prior art paper collecting trays or devices may generally be suitable for their intended purposes, they all appear to suffer from one or more drawbacks, such as size, complexity, cost, inability to be collapsed for storage, suitability for use with various machines or devices, etc.

Thus, a need presently exists for a tray which overcomes the disadvantages of the prior art.

OBJECTS OF THE INVENTION

It is an object of this invention to provide a paper collection tray which overcomes the disadvantages of the prior art.

It is another object of this invention to provide a paper collection tray which is effective to collect and collate paper or other sheets of material expelled from any type of home or office machine, such as but not limited to copiers, facsimile machines, scanners, printers, and combined devices.

It is another object of this invention to provide a paper collection tray which is simple in construction.

It is another object of this invention to provide a paper collection tray which is low in cost.

It is another object of this invention to provide a paper collection tray which is easy to use.

It is another object of this invention to provide a paper collection tray which is easy to assemble and disassemble.

It is another object of this invention to provide a non-collapsible paper collection tray.

It is another object of this invention to provide a paper collection tray which can be collapsed to facilitate storage and transportation.

It is another object of this invention to provide a paper collection tray which is adjustable to enable it to be used with various types of machines.

It is another object of this invention to provide a non-collapsible paper collection tray which can be formed easily, e.g., molded or fabricated.

It is another object of this invention to provide a non-collapsible paper collection tray which is arranged to be assembled and disassembled readily for storage.

SUMMARY OF THE INVENTION

These and other objects of the invention are accomplished by providing a tray for use with an electronic machine, e.g., copier, facsimile, printer, scanner, multi-function device, from which sheets of paper are expelled. The machine is arranged to be located on a support surface, e.g., a table, desk, etc., having an edge.

The tray is arranged to be releasably mounted on the support surface adjacent and completely below the machine to collect the sheets of paper expelled from the machine and to collate them into a collated stack. The tray basically comprises a basket section, an anchor section, and an intermediate support section. The anchor section is a generally planar panel arranged to be located on the support surface under the electronic machine, whereupon the weight of the machined holds the anchor section in place. The intermediate support section is also a generally planar panel which is hingedly connected to the anchor section and is arranged to overhang the edge of the support surface of the table, desk, etc. The basket section is hingedly connected to the intermediate support section so that said basket is suspended from said intermediate support section and overhangs the edge of the support surface.

The basket section has a wedge shaped interior bounded by a front wall. The front wall extends at an acute angle to vertical when the basket section is suspended from the intermediate section and overhanging the edge of the support surface, whereupon the first sheet of paper expelled from the machine drops directly into the hollow interior of said basket section and rests against the front wall. The successive sheet of paper which is expelled from the machine drops directly into the hollow interior of the basket section and rests against the first sheet, thereby forming a collated stack of sheets of paper.

In accordance with one preferred aspect of the invention the tray is a collapsible member which is arranged to be extended from a compact state to an extended state and vice versa. When the tray is in the compact state the basket section is collapsed to in the form of a generally planar configuration. The anchor section and the intermediate support section are arranged to be collapsed so that they confront the collapsed basket section, thus resulting in a very compact unit, e.g., one which can be readily stored and/or transported.

In accordance with another aspect of this invention a backing plate may be provided for releasable securement to the tray for use in helping to hold the basket in the proper orientation when the desk, table or other member forming the support surface for the machine doesn't include a vertical side or wall.

In accordance with another preferred aspect of this invention the paper collection tray may be non-collapsible, i.e., of a fixed size and shape. That tray comprises a basket section, an anchor section, and an intermediate support section. The anchor section is arranged to be located on the support surface under the electronic device, whereupon the weight of the electronic device holds the anchor section in place. The intermediate support section is arranged to overhang the edge of the support surface. The basket section is connected to the intermediate support section so that the basket section is suspended from the intermediate support section and overhangs the edge of the support surface. The basket section has a wedge shaped interior bounded by a front wall, a bottom wall, and a rear wall. The front wall has a somewhat concave inner surface and extends at an angle to vertical when the basket section is overhanging the edge of the support surface, whereupon the first sheet of paper expelled from the device drops directly into said hollow interior of the basket section and rests on the bottom wall and against the concave inner surface of the front wall, and wherein the next successive sheet expelled from the device drops into the hollow interior and rests against the first sheet, thereby forming a collated stack of sheets of paper. If desired the basket section may include sidewalls or portions of sidewalls.

DESCRIPTION OF THE DRAWINGS

Other objects and many of the attendant advantages of this invention will become readily appreciated as the same becomes better understood by reference to the following detailed description, when considered in connection with the accompanying drawings, wherein:

FIG. 3A is a sectional view taken along line 3A—3A of FIG. 2;

FIG. 3B is a view similar to FIG. 3A but showing a portion of an alternative embodiment of the invention, the remainder of this alternative embodiment being the same as the embodiment of FIG. 1;

FIG. 4 is a sectional view taken along line 4—4 of FIG. 2;

FIG. 7 is a sectional view taken along line 7—7 of FIG. 1;

FIG. 8 is an isometric view, partially broken away, showing the tray of the subject invention stored in a folded or compact state within a reclosable, flexible storage bag;

DETAILED DESCRIPTION OF THE PREFERRED EMBODIMENT

Figure 1:
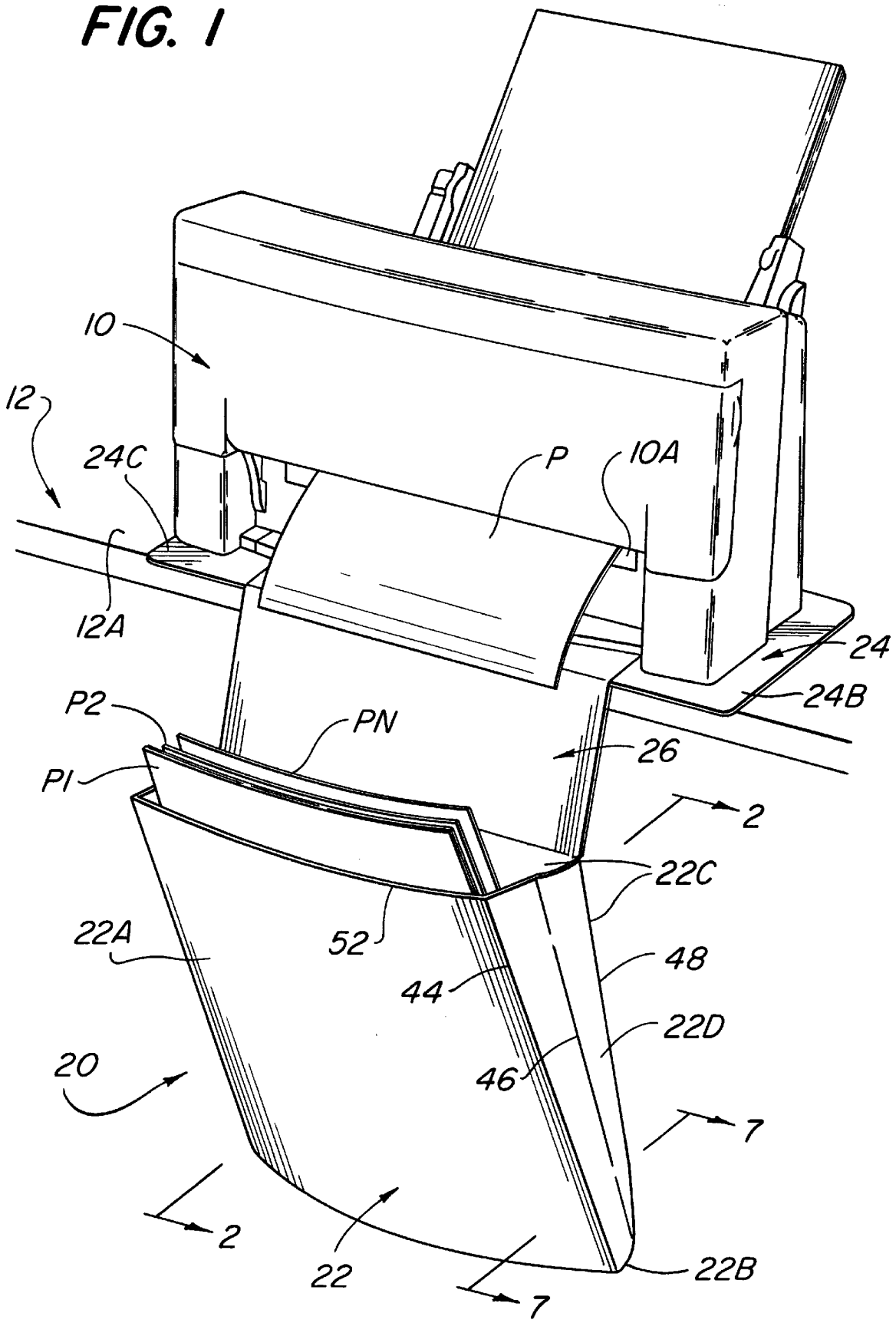
FIG. 1 is an isometric view of a collapsible paper collection tray constructed in accordance with the subject invention shown in its expanded state and in proper position for collecting and collating pages as they are expelled from a conventional type of printer disposed on a table or desk having a side wall.
Figure 2:
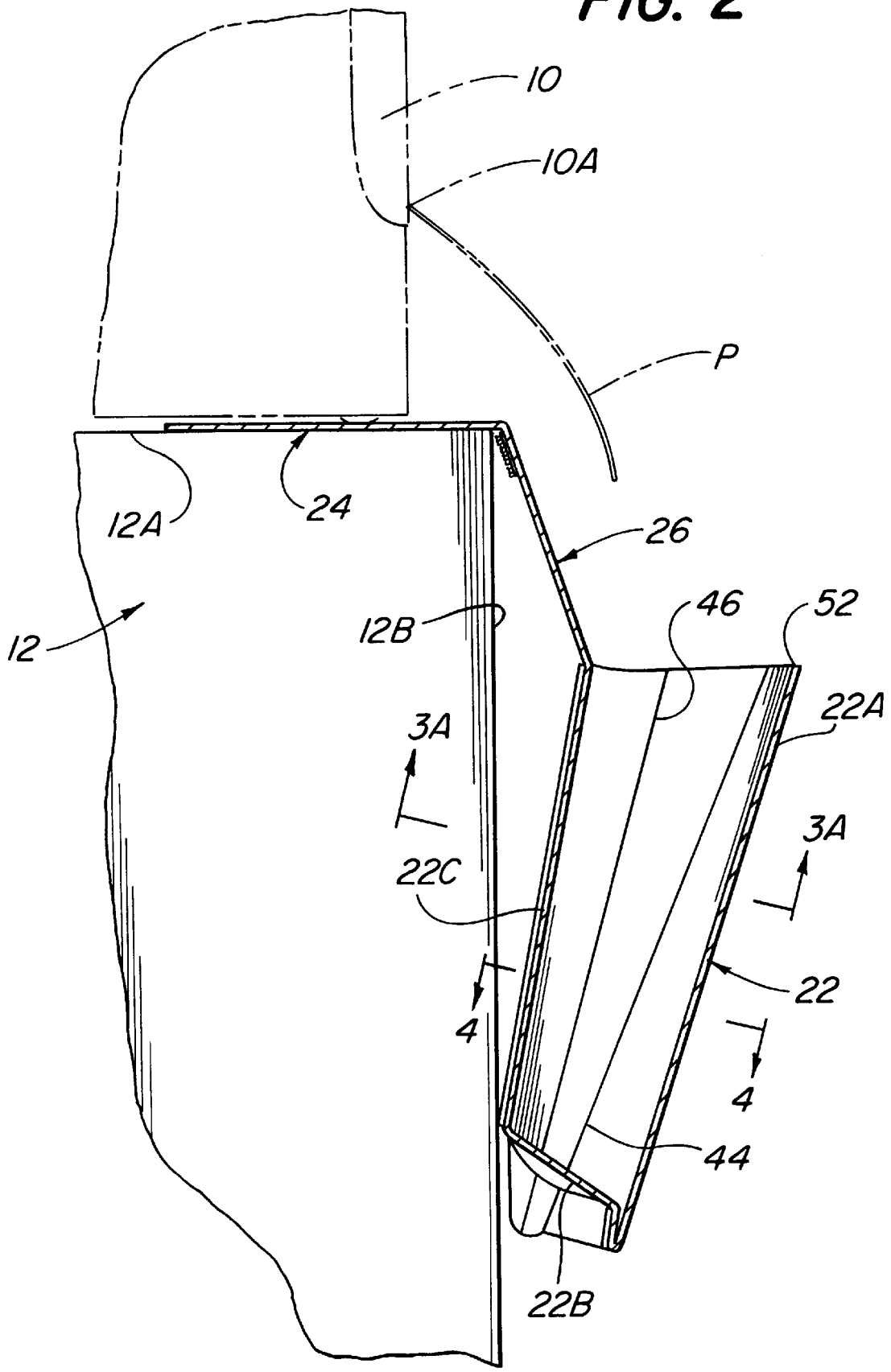
FIG. 2 is a sectional view taken along line 2—2 of FIG. 1.

Referring now to the drawing wherein like reference characters refer to like parts, there is shown at 20 in FIG. 1 an paper collection tray constructed in accordance with the subject invention. The tray is arranged to be used with any type of machine or equipment which will expel individual sheets of paper to be collected and, if desired, collated, and which machine/equipment does not itself include any paper collection/collation means. Examples, of machines and equipment for which the subject invention is of particular utility are dot matrix printers, ink jet printers, laser printers, facsimile machines, scanners, copiers, designed for small office or home use. In the embodiment shown herein the machine is a conventional ink jet printer 10, but that device is merely exemplary of the various devices with which the subject invention may be used. The ink jet printer 10 includes an exit port 10A from which sheets of paper P are expelled as each is printed. The printer 10 is arranged to be disposed on a table, desk or other piece of furniture 12 having a horizontal support surface. As shown in FIG. 2 the printer is disposed on a table having a horizontal top surface 12A and a vertical side surface 12B so that the printer 10 is located adjacent the edge of those two surfaces. That placement is important so that a portion of the paper collection tray 20 (to be described later) can be disposed under the printer and a portion (also to be described later) overhanging the edge of the desk S and in a desired orientation to collect, collate and stock the pages P as they are expelled from the printer.

The paper collection tray 20 basically comprises a hollow basket 22, a pad or anchor section 24, and an intermediate support section 26, which are hingedly connected to one another so that the tray 20 can be folded and unfolded, as desired. In particular, the foldability feature enables the paper collection tray 20 to be readily folded (collapsed) for storage, and unfolded (expanded) for use. In addition the hinged connection of portions of the tray enables the adjustment of its position with respect to the printer (or other device) and the surface on which the printer is located so that the tray's basket is in the desired position to collect and collate the exiting pages P, as will be described later.

Figure 6:
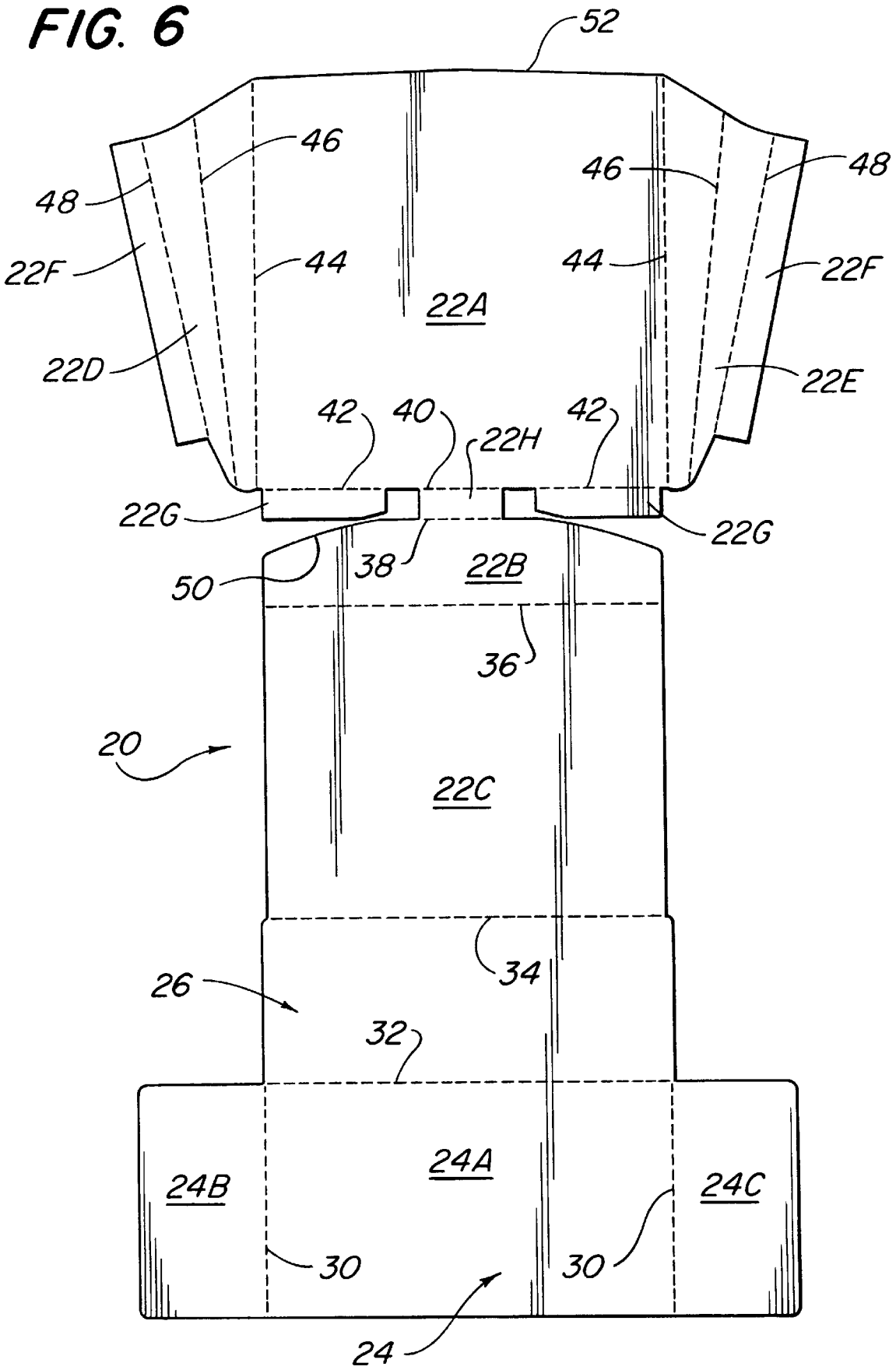
FIG. 6 is a plan view of a blank of material which is die cut into the shape shown to be assembled into the collapsible paper collection tray of FIG. 1.

As best seen in FIG. 6, the anchor section 24 is a planar panel of generally rectangular shape. The anchor section 24 includes a central portion 24A and pair of wing portions 24B and 24C. The wing portions are hingedly mounted on opposite sides of the central portion by respective fold lines 30 so that each wing can be folded over the contiguous portion of the central portion 24A when the tray is folded up into its compact configuration for storage like shown in FIG. 8. The anchor section 24 arranged so that its wing portions 24B and 24C can be flattened out so that all three portions are coplanar and disposed on the top surface 12A of the desk under the printer 10 as shown in FIG. 1, whereupon the weight of the printer holds the anchor section 24 in place. The intermediate support section 26 is also a planar panel which is also of generally rectangular shape and is of a width approximately equal to the width of the central portion 24A of the anchor section. The intermediate support section 26 is hingedly connected to the anchor section 26 via a fold line 32 and is arranged to overhang the edge of the desk top 12A with the fold line 32 being located at the edge of the desk top as shown in FIGS. 1 and 2.

The basket section 22 is formed of plural panels, to be described hereinafter, and is arranged to be unfolded or expanded to form a hollow member (like that shown in FIGS. 1 and 2) into which the exiting pages P from the printer may drop. The basket section is hingedly secured to the intermediate support section along a fold line 34, so that when the anchor section 24 is in place on the desk top the basket section 22 is located below the exit port 10A of the printer and tilted outward from the desk's sidewall 12B so that as each page P is expelled from the printer it drops downward and assumes an orientation lying against a front wall of the basket (to be described later), thereby stacking and collating the pages. The basket section 22 basically comprises a generally rectangular planar rear panel 22A, a planar bottom panel 22B, a generally rectangular planar front panel 22C, a pair of planar gusseted side panels 22D and 22E, a first pair of holding tabs 22F, a second pair of holding tabs 22G, and a planar bridging strip 22H. The lower edge 50 of the bottom panel 22B is slightly arcuate, except for its central portion which is linear. The rear wall panel 22C is hingedly connected to the intermediate section 26 by the fold line 34. The bottom wall panel 22B is hingedly connected to the rear wall panel 22C by a fold line 36. The planar bridging strip 22H is hingedly connected to the bottom wall panel 22B by a fold line 38. The bridging strip 22H is also hingedly connected to the front wall panel 22A by a fold line 40. The mounting tabs 22G are each generally rectangular planar members having one corner cut away at a slight angle and each is hingedly connected to a respect bottom edge of the front wall panel 22A by a fold line 42 which constitutes extensions of fold line 40. Each of the side gussets is a generally planar, triangular shaped member having three fold lines 44, 46, and 48 which diverge slightly from one another as shown in FIG. 6. Each fold line 44 defines a respective marginal edge of the front panel wall 22A and forms an outer fold of the side gussets 22D and 22E of the basket. Each of the fold lines 48 forms a respective outer folds of those side gussets, while each fold line 46 forms their inner fold. Each of the mounting tabs 22F is hingedly connected to a respective side gusset via a respective outer fold line 48.

In accordance with one preferred embodiment of the invention shown herein the various panels forming the tray 20 are made up of a unitary, thin blank of any suitable material, e.g., pressboard, paperboard, cardboard, plastic, etc., which has some rigidity, yet which is capable of being folded along the aforementioned fold lines to form the tray. Several of these fold lines (to be described later) enable the tray to be completely folded upon collapsed in a compact state for storage, and unfolded to an expanded state for use. It must be pointed out at this juncture that a tray constructed in accordance with this invention need not be made so that it is collapsible. Thus, the subject invention contemplates construction of some collection trays which are collapsible and others which are fixed or not collapsible. Several embodiments of fixed or non-collapsible paper collection trays constructed in accordance with this invention are shown in the drawings hereof and will be described later.

The formation of the basket of the tray 20 will now be described with reference to FIGS. 2 and 6. The holding tabs 22G are brought into abutment with the contiguous portions of the inner surface of the front wall panel 22C by folding them along their respective fold lines 42 and securing them in place with an adhesive (not shown). As best seen in FIG. 7 (and which will be described later) the top edge of each of the tabs, when secured in place, forms a stop or retaining ledge upon which the arcuate lower edge 50 of the bottom wall panel 22B rests when the basket is unfolded to its hollow or open configuration. The front wall panel 22A is brought into a confronting relationship with the rear wall panel 22C by folding those panels along the fold line 38. The gusset fold lines 44–48 are then folded such that the central fold line 46 of each gusset forms an inner corner and the outer fold lines 44 and 48 of each gusset forms an outer corner. When the gussets are in that state and the front wall panel 22A and rear wall panel 22C are confronting each other, the holding tabs 22F of the gussets are folded along their respective fold lines 48 so that they are brought into abutment with the contiguous outer surface of the rear wall panel 22C and secured in place by means of an adhesive (not shown). This completes the formation of the basket, albeit the basket will be in its compact or folded state at this time.

Figure 9:
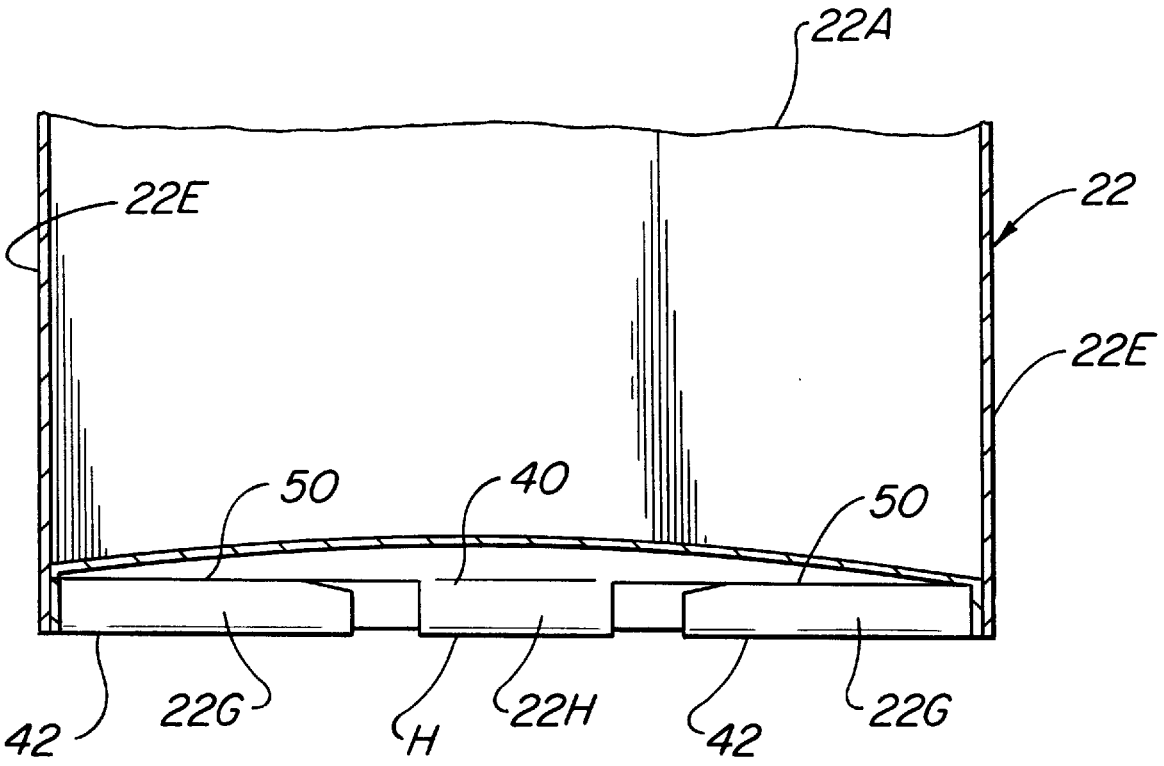
FIG. 9 is a sectional view taken along line 9—9 of FIG. 7.

In order to unfold or expand the basket 22 so that its hollow interior is open to the maximum (at which time its interior is wedge-shaped), the lower wall panel 22B is folded along fold line 36, thereby reversing the folds of fold lines 38 and 40. The lower edge 50 of the bottom wall panel 22B is then brought over and onto the top edge of the adhesively secured mounting tabs 22G as shown in FIG. 7, thereby supporting the bottom wall panel 22B on those tabs. Accordingly the basket will now be in the open state like that shown in FIG. 2. At this time the front wall 22A will be lightly arcuate, i.e., bowed outward as seen in FIG. 4. The open top of the basket forms the mouth of the basket to receive the ejected sheets P. Since the front wall 22A is slightly bowed outward and the top edges of the adhesively secured mounting tabs 22G are parallel to their respective fold lines 42, when the bottom wall is in place on those tab edges the bottom wall will assume a somewhat arched shape, i.e., be slightly higher in the center than at its side ends as shown clearly in FIG. 9. This feature in combination with the orientation of the basket (to be described later) acts to ensure that the sheets P exiting from the machine which are received into the basket will fall to the front wall.

The basket section 22 is hingedly secured to the intermediate section 26, which in turn is hingedly connected to the anchor section 24. Thus, when the anchor section is in place as described above, the intermediate section with the basket section depending therefrom will overhang the edge of the top of the desk so that the top edge 52 of the front wall of the basket section, i.e., the front edge of the basket's mouth, is located below and in front of the paper outlet port 10A of the printer. The position of the anchor section with respect to the printer can be adjusted, i.e., moved backward, forward and/or side to side until the top edge of the front of the basket is in the path that the paper expelled from the printer will follow when dropping under the force of gravity. Since the basket is hingedly connected to the intermediate section and is wedge-shaped the lower edge of its inner wall 22C will automatically pivot inward to engage the vertical side surface 12B of the desk or table as shown clearly in FIG. 2. This action tilts the basket's front wall forward so that the arcuate inner surface of the front wall 22A extends generally at an obtuse angle to the vertical down direction as shown in FIGS. 2 and 7. Accordingly, the first sheet of paper P which is expelled from the printer will drop into the basket onto its arched bottom wall 22B and automatically tilt forward into engagement with the forward sloped inner surface of the front wall of the basket, whereupon the sheet's printed surface will abut the inner surface of the basket's front wall. That first sheet is shown in FIG. 1 and designated by the reference number P1. Each succeeding sheet which is expelled will follow a similar path and automatically tilt into engagement with the previously received sheet, thereby forming a collated stack of papers (P2–PN) in the basket.

The location of the top or mouth of the tray's basket relative to its pad or anchor section is of considerable importance to ensure proper paper collection and collation. Thus, the mouth of the tray's basket section is designed to be adjustably located where the leading edge of various weights of paper from the printer begin to assume a horizontal orientation after they drop out of the printer.

Figure 5:
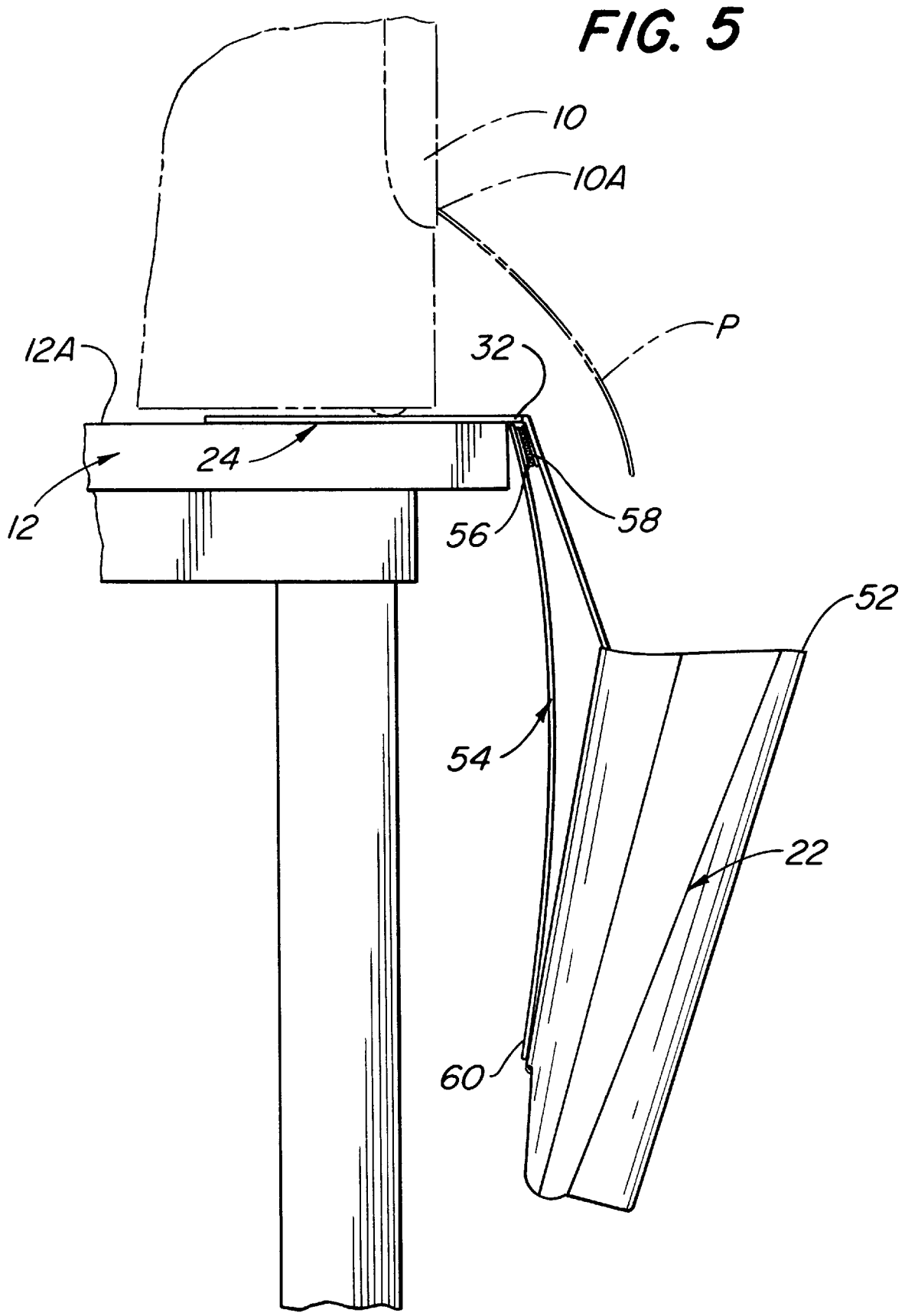
FIG. 5 is a side elevational view similar to FIG. 5, but showing the paper collection tray of this invention used with an optional or auxiliary backing plate, also forming a portion of the subject invention, for properly positioning the tray to collect and collate pages as they are expelled from a printer disposed on a table or desk not having a side wall.

While the tolerance of the position of the mouth of the tray's basket with respect to its anchor section (and hence the printer) is quite large, locating the tray on a table, counter or other horizontal support surface having no vertical side surface which the bottom edge of the real wall of the basket could engage (like the arrangement shown in FIG. 5) would place the basket's mouth too far out of position to receive the exiting papers to stack and collate them properly. Thus, for such applications, the paper collection tray 20 of this invention will likely require use of an auxiliary or optional backing plate 54 (FIG. 5) to hold the basket in the correct position and orientation like described above. The optional backing plate 54 basically comprises a generally rectangular, planar member formed of the same material as that making up the tray 20. The width of the backing plate is slightly less than the width of the rear wall 22C and the height of the backing plate is slightly less than the combined height of the rear wall 22C and the intermediate section 26. The backing plate includes a strip 56 of the multi-hook component of a VELCRO® fastening system. This strip is adhesively secured along the top edge on the front surface of the backing plate. A cooperating strip 58 (FIGS. 3A and 5) of the multi-loop component of a VELCRO® fastening system is adhesively secured along the under surface of the intermediate support section 26 contiguous with the fold line 32. The backing plate 54 is releasably secured to the tray 20 by bringing its VELCRO® strip 56 into engagement with the cooperating VELCRO® strip 58. The lower edge 60 of the backing plate 54 will engage the bottom of the outer surface of the rear wall 22C of the basket section 22 to prevent it from tilting inward excessively. Such excessive tilting could result in the mouth of the basket 22 extending at too great an angle to reliably receive the paper sheets P as they are expelled from the printer. Thus, the backing plate 54 performs a stop function in a similar manner to that provided by the vertical sidewall 12B of the desk or table.

In FIG. 3B there is shown an alternative means for connecting the backing plate 54 to the tray 20. In particular, two or more buttons or dots 62 of the multi-hook component of a VELCRO® fastening system are used in lieu of the strip 56. Each of these buttons will be adhesively secured along the top edge of the backing plate at the respective corners for engagement with the strip 58 on the tray 20. Alternatively, the tray 20 may include two or more buttons or dots (not shown) of the multi-hook component of a VELCRO® in lieu of the strip 58 and which cooperate with the buttons or dots 64 to releasably secure the backing plate to the tray 20.

The set up and adjustment of the tray 20 of this invention can be accomplished quite readily. In particular, once the tray is unfolded and assembled as described above (assuming that the particular tray is constructed to be foldable), and if necessary the optional backing plate attached, all that is required is to simply set the anchor section or pad 24 on the counter or furniture top so that the basket 22 of the tray hangs over the edge. It is important to have the fold at the interface of the anchor section and the intermediate section tight to the top edge of the counter or the furniture on which the printer is to be located. Once this is accomplished the printer or other device with which the tray will be used is placed upon the anchor section such that the paper P will, upon exiting, be in line and centered over the basket's mouth. The printer can then be either moved forward or backward until a test paper exiting from the printer strikes the inside surface of the front wall or panel of the basket just inside its top edge 52. To that end adjustments to the position of the tray can be effected by moving the pad or anchor section slightly in or out from the edge of the counter or furniture top. Moving it in will cause the tray to move up and out further from the printer, while moving it out will have the opposite effect. The weight of the printer will hold the tray in position against accidental displacement. Once the location of the machine in the desired operating position has been determined, that position should be noted for future set-up.

As should be appreciated by those skilled in the art, when use of the paper collection tray is no longer needed or desired, it may be removed by withdrawing its anchor section from under the printer 10. The tray can then be folded up into its compact state for convenient storage. To that end the bottom wall panel is lifted off of the support tabs and pivoted downward, the side gussets are then compressed so that the front wall panel and rear wall panel are immediately confronting each other. The wings of the anchor section are then folded over the central portion of the anchor section. The tray can then be folded along the fold line 34, whereupon the tray will now be of an overall rectangular shape, which can be readily fit within any container, e.g., a flexible reclosable plastic bag 70 like shown in FIG. 8. The backer panel 54 may also be disposed in that bag.

While the subject invention has particular utility for use with machines that do not include their own paper collection trays, use is not limited to such machines. Thus, the subject invention can be used with machines that include their own paper collection trays. For example, with a machine having a removable paper collection tray the subject invention can be used after the machine's tray has been removed. In other cases, e.g., machines having spring loaded paper output guides, the tray of this invention can be used by merely taping down the output guides.

As will be appreciated from the foregoing the subject invention provides an inexpensive, convenient and effective means for collecting and collating pages as they are expelled from any type of home or office machine. Moreover, when the tray of this invention is formed so that it is foldable or collapsible storage and/or transportation of the tray is expedited.

Figure 10:
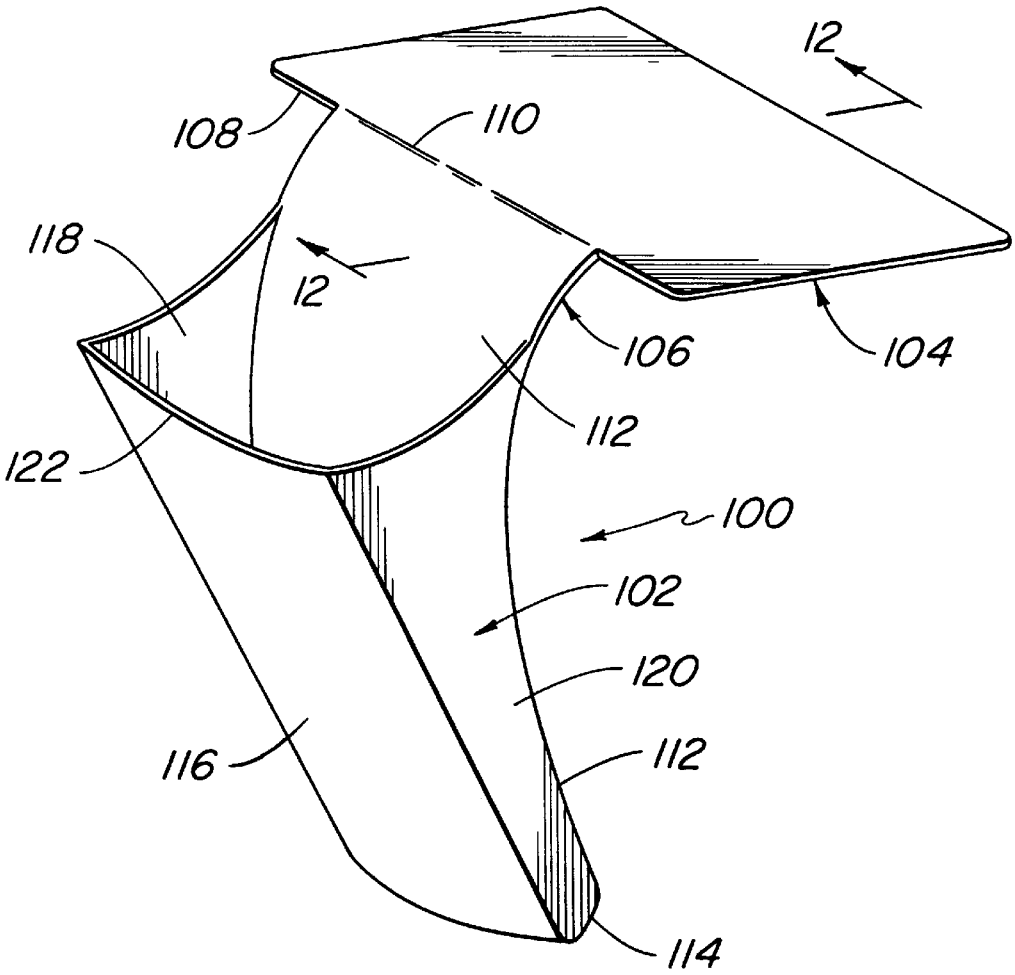
FIG. 10 is an isometric view of a preformed and non-foldable embodiment of a paper collection tray constructed in accordance with the subject invention, this embodiment being arranged to be readily molded.
Figure 11:
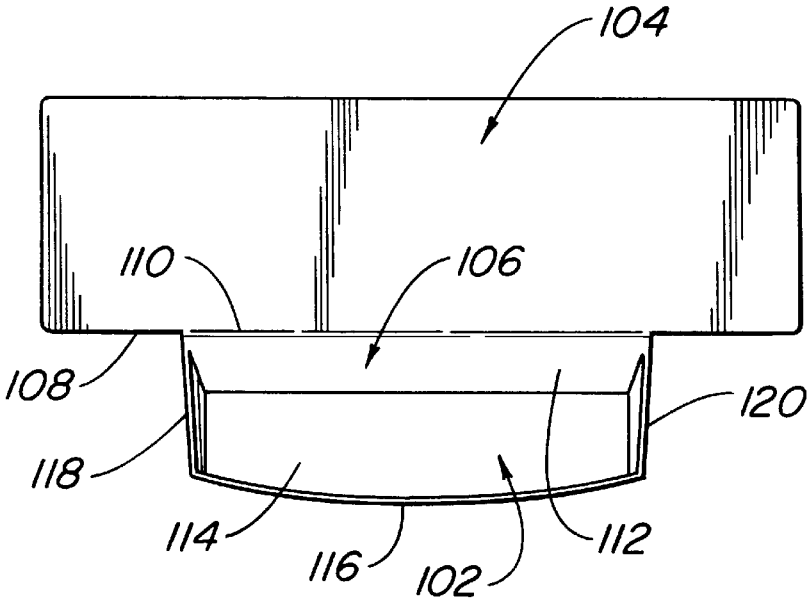
FIG. 11 is a top plan view of the embodiment of the paper collection tray of FIG. 10.
Figure 12:
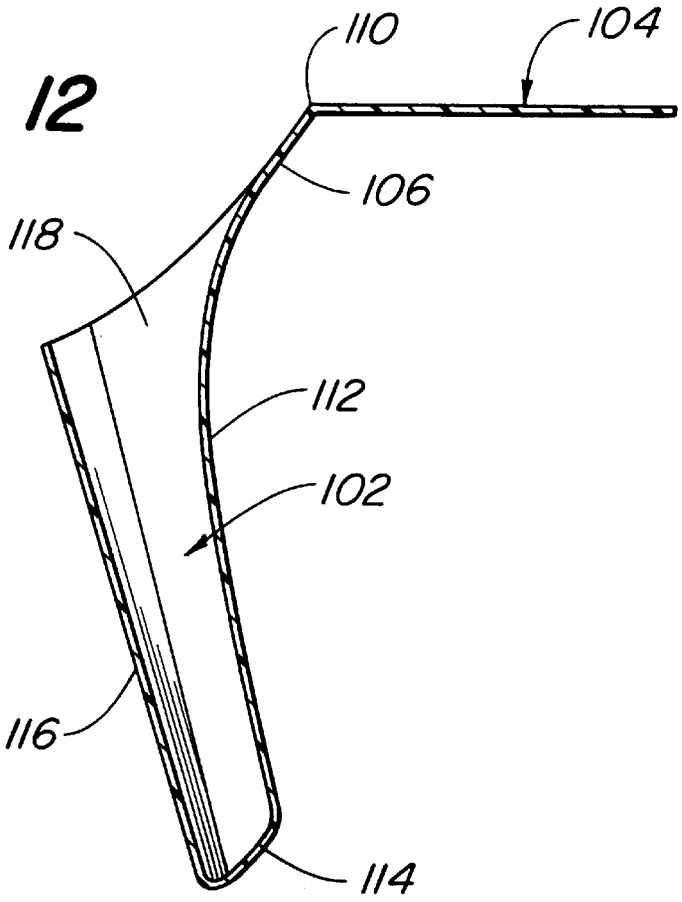
FIG. 12 is a sectional view taken along line 12—12 of FIG. 10.

In FIG. 10 there is shown a first embodiment of a fixed or non-collapsible paper collection tray 100 constructed in accordance with this invention. The tray 100 is of a similar construction to the collapsible paper collection tray described heretofore. Thus, the tray 100 basically comprises a hollow basket 102, a pad or anchor section 104 and an intermediate support section 106. All of these sections are fixedly secured to one another, i.e., not movable with respect to one another. In accordance with the preferred embodiment of the invention, the paper collection tray 100 is injection molded of any suitable plastic material. The anchor section 104 is a planar panel of generally rectangular shape. The width of the anchor section is approximately the same as the whole width of the anchor section of the collapsible paper collection tray 20. The intermediate support section 106 merges with the anchor section 104 along the front edge 108 of the anchor section in a corner joint 110. The intermediate support section is of a width similar to the intermediate support section of the collapsible paper collection tray 20, but unlike that section is not planar. Instead, the intermediate support section 106 of the paper collection tray 100 is arcuate, i.e., constitutes a sheet which is bowed outward as shown in FIGS. 10 and 12.

The basket section 102 basically comprises a rear panel 112 which is arcuate and merges smoothly into the intermediate section 106. In the upper portion of the rear wall the radius of curvature is greater than at the lower portion, i.e., the lower portion takes on a more planar configuration, as shown clearly in FIG. 12. In addition to the rear wall 112, the basket section 102 comprises a bottom wall 114, a front wall 116, and an opposed pair of side walls 118 and 120. The front wall 116 is slightly bowed outward, like the front wall of the collapsible paper collection tray 20 when it is assembled, as described earlier. The bottom wall 114 is constructed similarly to the bottom wall of the collapsible paper collection tray, that is it is preferably bowed upward. However, the bottom wall could, if desired, be planar. In either case the bottom wall 114 merges with the bottom edge of the rear wall 112 along its back edge and with the lower edge of the front wall 116 along its front edge. The top edge 122 of the front wall 116 can either be linear or slightly concave, as shown. The side wall 120 extends between the right side edge of the rear wall 112 of the basket section 102 and the corresponding edge of the front wall 116 of that section. In a similar manner the side wall 118 extends between the left side edge of the rear wall 112 and the corresponding edge of the front wall 116.

As should be appreciated by those skilled in the art, the arcuate shape of the intermediate section and the rear wall of the basket section, coupled with the fact that the intermediate section extends outward from the front edge 108 of the anchor section at an angle, ensures that the front wall 116 of the basket section 102 is oriented in a similar manner to that described with respect to the collapsible paper collection tray when that tray is properly set up for collection and collation of papers ejected from the printer.

Figure 13:
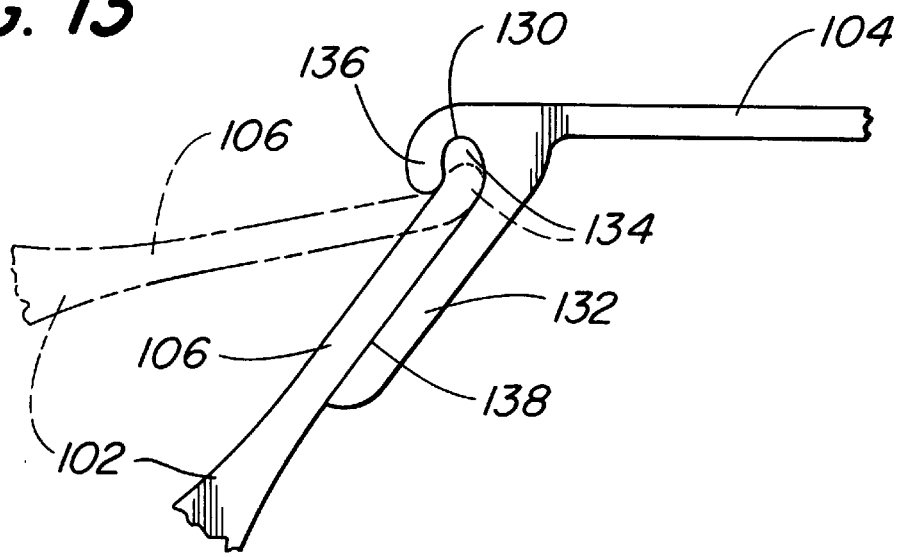
FIG. 13 is a side elevational view of a portion of another preformed, readily moldable embodiment of a paper collection tray constructed in accordance with the subject invention, this embodiment being arranged to be assembled/disassembled by the user.

In lieu of having the entire paper collection tray 100 molded as an integral unit, the unit may be formed as two pieces which are arranged to be assembled together. This arrangement enables the device to be packaged in an unassembled state, wherein it takes up less room, and to be stored in that state. To that end, as shown in FIG. 13, the anchor section 104 includes a recess 130 and associated flange 132 extending along its front edge 108 for the width of the intermediate section 106. The recess and flange are arranged to cooperate with a bead 134 extending along the top edge of the intermediate section 106. The intermediate section 106 and the basket section 102 in this embodiment are formed as an integral unit, while the anchor section 104 is formed as a separate integral unit. As can be seen in FIG. 13, the front edge of the anchor section 104 includes a curved lip 136 forming a rounded recess 130 therein. The recess extends the full width of the lip. Extending outward from the underside of the anchor section or pad 104 is the flange 132. This is an elongated planar member which extends at an acute angle, e.g., approximately 45°, to the plane of the anchor section 104. The top edge of the intermediate support section 106 includes the heretofore identified bead 134. The bead is a bulbous member which extends along the full width of the intermediate section 106. The bead 134 is arranged to be received within the recess 130 in the front edge of the anchor section 104. To that end, the integral unit making up the basket section 102 and the intermediate section 106 is oriented so that the portion of the intermediate section contiguous with the bead is approximately horizontal, whereupon the bead 134 extends upward at a slight angle, as shown by the phantom lines in FIG. 13. The bead is then introduced into the space between the angled flange 132 and the recess 130 so that the bead 134 enters the recess 130. The basket section and its integral intermediate section can then be tilted downward to bring the underside of the intermediate support section 106 which is contiguous with the bead 134 into engagement with the front surface 138 of the angularly extending flange 132, as shown by the solid lines in FIG. 13. This action thus assembles the two components, that is, connects the combination basket/intermediate section to the anchor section, with the basket section being oriented in the desired orientation, like that described heretofore, to receive and collate the papers exiting from the printer.

It should be pointed out that the embodiment shown in FIGS. 10-13 is particularly suited for use with papers that are of a conventional letter size, that is 8½×11 inches.

Figure 14:
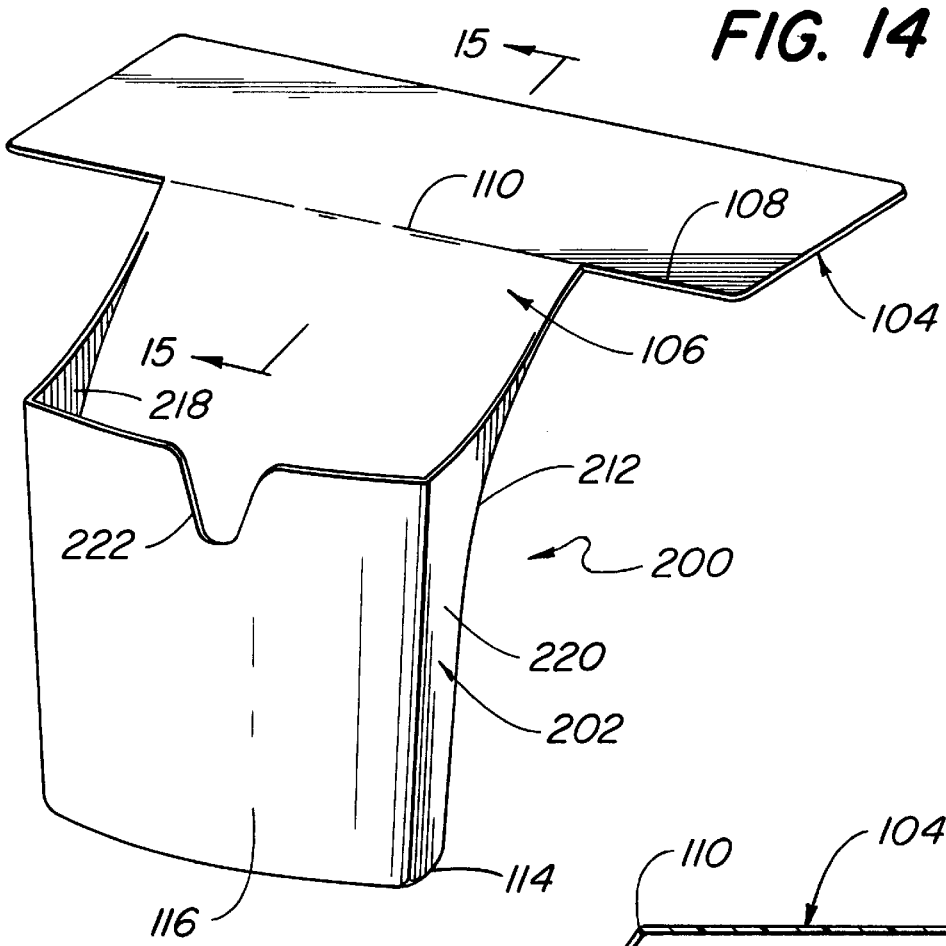
FIG. 14 is an isometric view of another preformed, readily moldable embodiment of a paper collection tray constructed in accordance with the subject invention.
Figure 15:
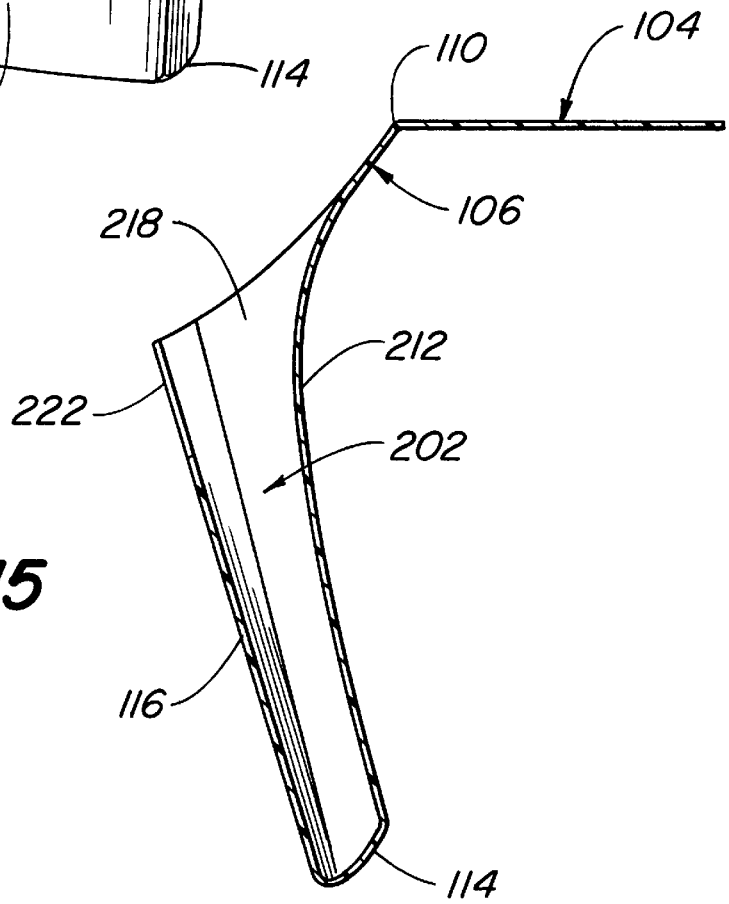
FIG. 15 is a sectional view taken along line 15—15 of FIG. 14.

In FIG. 14 there is shown an alternative embodiment of the fixed paper collection tray 200. The paper collection tray of FIG. 200 is similar in construction to tray 100 of FIG. 10, except that its basket section 202 is longer (deeper) to accept legal size pages, that is 8½×14 inch. In order to enable the paper collection tray 202 to be used for collecting 8½×11 inch paper as well, the front wall 116 of the basket section 202 is of a height similar to the height of the front wall 116 of the paper collection tray 100, while the basket section's rear wall 212 and its side walls 218 and 220 are longer. As best seen in FIG. 15, the side walls 218 and 220 merge up to the intermediate section 106 at approximately the same location below the corner 110 as in the embodiment 100 of FIG. 10.

In order to facilitate the removal of 8½×11 inch pages collected within the basket 202 of the tray 200, the front wall 116 includes a generally V-shaped notch 222 at its top edge, and into which the user can place his or her fingers to grasp the pages.

The paper collection tray 200 shown in FIG. 14 can also be constructed as a two-piece unit, like that described heretofore with respect to FIG. 13.

Figure 16:
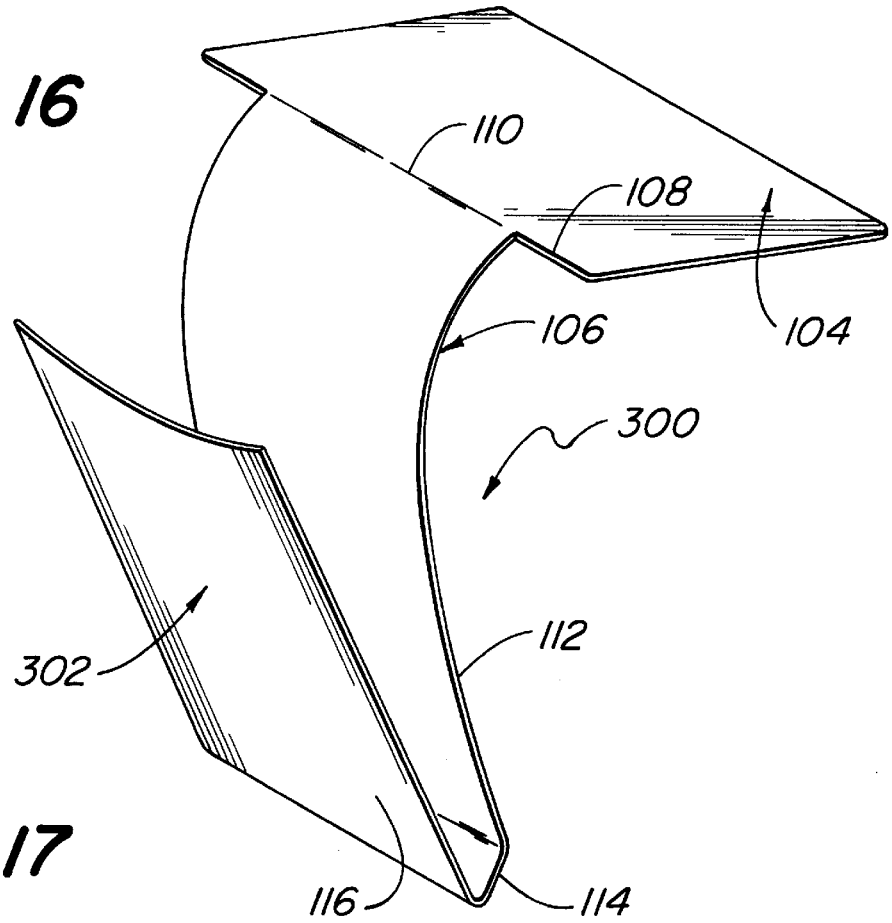
FIG. 16 is an isometric view of yet another preformed and non-foldable embodiment of a paper collection tray constructed in accordance with the subject invention, this embodiment arranged to be readily fabricated.

In FIG. 16 there is shown yet another alternative embodiment of a fixed, that is non-collapsible, paper collection tray 300 constructed in accordance with this invention. Unlike the other fixed embodiments described heretofore, the embodiment 300 shown in FIG. 16 is arranged to be fabricated, that is formed from a planar sheet of any suitable material, e.g., plastic, and then bent permanently into the configuration shown.

Figure 17:
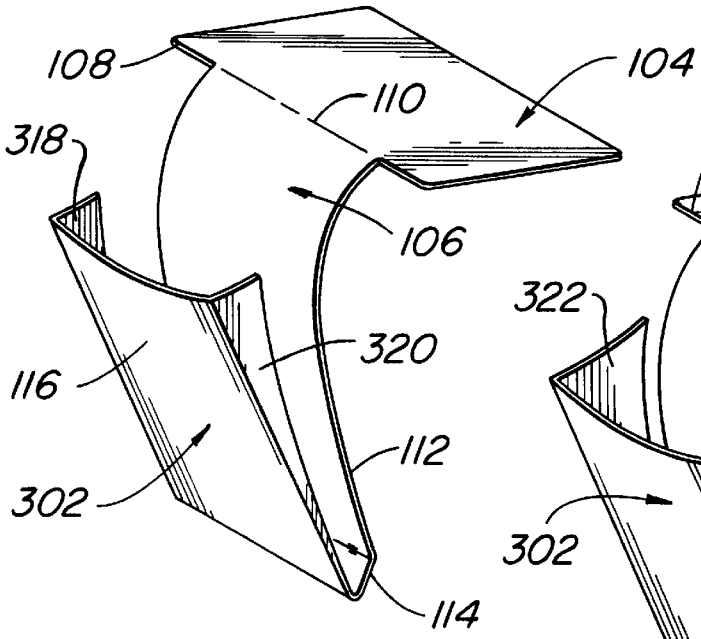
FIG. 17 is an isometric view of yet another preformed, readily fabricatable embodiment of a paper collection tray constructed in accordance with the subject invention.
Figure 18:
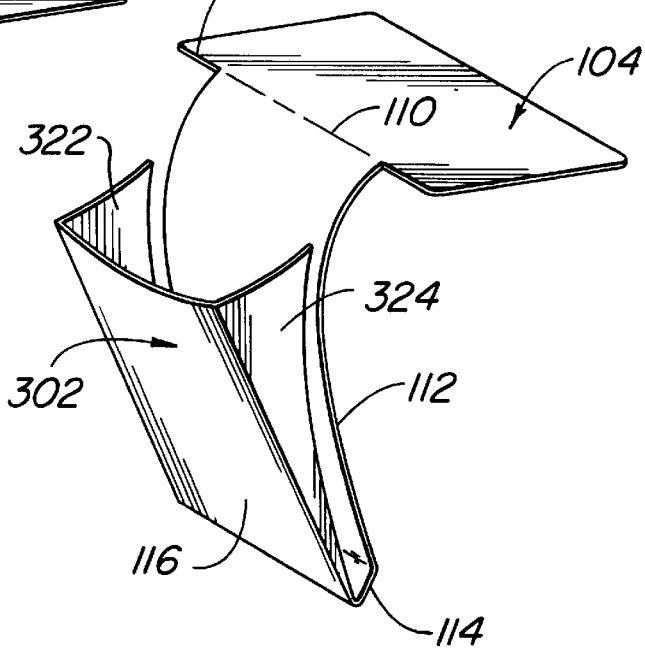
FIG. 18 is an isometric view of yet another preformed, readily fabricatable embodiment of a paper collection tray constructed in accordance with the subject invention.

Thus, as can be seen in FIG. 16 the paper collection tray 300 includes an anchor section 104 (like that described heretofore), an intermediate section 106 (also like that described heretofore) and a basket section 302. The basket section 302 is similar in several respects to the basket sections of the embodiments described heretofore, except that it is not fully enclosed. In particular, the sides of the basket section 302 are either fully open (as shown in FIG. 16) or partially closed (as will be described later with reference to FIGS. 17 and 18). In the fully opened embodiment, that is an embodiment without any sidewalls, like that shown in FIG. 16, the lower edge of the rear wall 112 of the basket section 302 merges with the rear edge of the bottom wall 114 while the front edge of the bottom wall merges with the lower edge of the front wall 116. The bottom wall may be slightly arcuate, like that described heretofore, or planar. In any case it preferably extends at an angle to the horizontal, as shown in FIG. 16. The front wall 116 is preferably bowed outward, like that described heretofore but may, if desired, be planar.

If it is desired to partially close the sides of the basket section, a pair of side flanges may be provided to form partial side walls for the basket section. For example, the embodiment of the tray shown in FIG. 17 the basket section 302 includes a pair of side flanges 318 and 320 extending along the side marginal edges of the front wall 116 of the basket section to form respective side wall portions. Each of the side wall portions is generally triangular in shape to partially fill the space between the front wall and the rear wall of the basket section. Thus, the side walls or flanges 318 and 320 will tend to hold the papers in the basket, preventing them from sliding out through the open sides of the basket. In another alternative embodiment shown in FIG. 18 the side wall flanges, now identified by the reference numbers 322 and 324, extend from the basket section's front wall 116 to a position much closer to its rear wall 112, thereby further ensuring that the pages collected within the basket section do not fall out the sides.

Without further elaboration, the foregoing will so fully illustrate my invention that others may, by applying current or future knowledge, readily adapt the same for use under various conditions of service.

I claim:

1. A tray for use with an electronic device from which sheets of paper are expelled, the device being arranged to be located on a support surface having an edge, said tray being arranged to be releasably mounted on the support surface adjacent and completely below the electronic device to collect the sheets of paper which are expelled from the device, said tray comprising a basket section, an anchor section, and an intermediate support section, at least said basket section and said intermediate support section being an integral one-piece unit, said anchor section being arranged to be located on the support surface under the electronic device, whereupon the weight of the electronic device holds said anchor section in place, said intermediate support section being arranged to overhang the edge of the support surface, said basket section being integrally formed with said intermediate support section so that said basket section is suspended from said intermediate support section and overhangs the edge of the support surface, said basket section having a wedge shaped interior bounded by a front wall, a bottom wall, and a rear wall, said front wall having a pair of sides and bowing outward between said sides to form a somewhat concave inner surface between said sides, said front wall extending at an angle to vertical when said basket section overhangs the edge of the support surface, said hollow interior being dimensioned so that a first sheet of paper expelled from the electronic device drops directly into said hollow interior of said basket section and rests on said bottom wall and against said concave inner surface of said front wall and a next successive sheet of paper expelled from the device drops into said hollow interior and rests against the first sheet, thereby forming a collated stack of sheets of paper.

2. The tray of claim 1 wherein said bottom wall has a somewhat convex inner surface.

3. The tray of claim 1 wherein said anchor sections and said intermediate section are hingedly connected to each other.

4. The tray of claim 1 wherein said tray is formed of as a integral member.

5. The tray of claim 1 wherein said sections are fixedly connected to each other.

6. The tray of claim 1 wherein said basket section additionally comprises an opposed pair of sidewalls.

7. The tray of claim 6 wherein said sidewalls merge with said rear wall of said basket section.

8. The tray of claim 6 wherein said sidewalls are spaced from said rear wall of said basket section.

9. A tray for use with an electronic device from which sheets of paper are expelled, the device being arranged to be located on a support surface having an edge, said tray being of a preformed shape and configuration and being arranged to be releasably mounted on the support surface adjacent and completely below the electronic device to collect the sheets of paper which are expelled from the device, said tray comprising a basket section, having a hollow interior, an anchor section, and an intermediate support section, at least said basket section and said intermediate support section being an integral one-piece unit, said anchor section being arranged to be located on the support surface under the electronic device, whereupon the weight of the electronic device holds said anchor section in place, said intermediate support section being arcuate and arranged to overhang the edge of the support surface, said basket section being integrally formed with said intermediate support section so that said basket section is suspended from said intermediate support section and overhangs the edge of the support surface, said basket section having a wedge shaped interior bounded by a front wall, a bottom wall, and a rear wall, said rear wall being arcuate and a smooth continuation of said arcuate intermediate support section, said front wall having a pair of sides and bowing outward between said sides to form a concave inner surface between said sides, said front wall also extending at an angle to vertical when said basket section is suspended from said intermediate section and overhanging the edge of the support surface, whereupon a first sheet of paper expelled from the device drops directly into said hollow interior of said basket section and rests on said bottom wall and against said concave inner surface of said front wall and wherein a next successive sheet expelled from the device drops into said hollow interior and rests against the first sheet, thereby forming a collated stack of sheets of paper.

10. The tray of claim 9 wherein said bottom wall has a somewhat convex inner surface.

11. The tray of claim 9 wherein said anchor section and said intermediate section are arranged to be releasably secured together by connection means.

12. The tray of claim 11 wherein said connection means comprises a recess in one of said anchor sections and said intermediate sections, and a mating shaped bead in the other of said anchor sections and said intermediate sections.

13. The tray of claim 9 wherein said tray is injection molded of a plastic material.

14. The tray of claim 9 wherein said tray is formed of a sheet of plastic material which is fabricated into the tray by bending.

15. The tray of claim 9 wherein said front wall of said basket includes a notch therein.

16. The tray of claim 9 wherein said basket section additionally comprises an opposed pair of sidewalls.

17. The tray of claim 16 wherein said sidewalls merge with said rear wall of said basket section.

18. The tray of claim 16 wherein said sidewalls are spaced from said rear wall of said basket section.

* * * * *